US006405152B1

(12) United States Patent
Hall et al.

(10) Patent No.: US 6,405,152 B1
(45) Date of Patent: Jun. 11, 2002

(54) PRECISION CALIPERING SYSTEM

(75) Inventors: David Hall, Plattsburgh; John E. Prim, West Chazy, both of NY (US)

(73) Assignee: Prim Hall Enterprises, Inc., Plattsburgh, NY (US)

( * ) Notice: Subject to any disclaimer, the term of this patent is extended or adjusted under 35 U.S.C. 154(b) by 0 days.

(21) Appl. No.: 09/080,651

(22) Filed: May 18, 1998

(51) Int. Cl.[7] ..... B65H 7/12
(52) U.S. Cl. ..... 702/170; 702/157; 412/14
(58) Field of Search ..... 271/262, 263, 271/265, 265.01, 265.06; 270/58.01, 265.04, 52.14, 53, 54, 58, 55; 356/381; 250/560; 412/11, 40, 43, 7, 12, 13, 21.1, 14; 702/170, 157

(56) References Cited

U.S. PATENT DOCUMENTS 3,750,294 A * 8/1973 Belke et al. ..... 33/147 L
3,928,117 A * 12/1975 Sarring ..... 156/477 B
3,928,118 A * 12/1975 Kuhns ..... 156/477 B
3,928,119 A * 12/1975 Sarring ..... 156/477
3,953,277 A * 4/1976 Kuhns ..... 156/360
3,966,185 A * 6/1976 McCain et al. ..... 270/37
4,420,747 A * 12/1983 Kistner ..... 340/674
4,479,642 A * 10/1984 Macey ..... 270/53
4,747,817 A * 5/1988 Newsome ..... 493/438
4,792,249 A * 12/1988 Lahr ..... 400/578
4,805,890 A * 2/1989 Martin ..... 271/203
4,826,149 A * 5/1989 Tucker ..... 271/263
4,850,582 A * 7/1989 Newsome ..... 271/185
4,861,014 A * 8/1989 Martin ..... 271/198
4,898,373 A * 2/1990 Newsome ..... 270/58
5,090,859 A * 2/1992 Nanos et al. ..... 412/11
5,125,642 A * 6/1992 Orsinger et al. ..... 271/263
5,193,962 A * 3/1993 Parker et al. ..... 412/8
5,201,504 A * 4/1993 Fallos et al. ..... 271/2
5,568,917 A * 10/1996 Buschhaus et al. ..... 270/58.01
5,601,163 A * 2/1997 Kent ..... 188/170
5,833,229 A * 11/1998 Prim ..... 271/11
5,927,703 A * 7/1999 Endo ..... 271/10.03
5,979,316 A * 11/1999 Baum ..... 101/216
6,092,893 A * 7/2000 Yokoi et al. ..... 347/104
6,129,352 A * 10/2000 Stab ..... 271/302

* cited by examiner

*Primary Examiner*—Marc S. Hoff
*Assistant Examiner*—Carol S. W Tsai
(74) *Attorney, Agent, or Firm*—Volpe and Koenig P.C.

(57) ABSTRACT

Apparatus and method for counting the number of inserts pulled each cycle from each hopper of an inserting machine. The caliper is a precision mechanism for accurately counting single, double, triple, quadruple and even quintuple fed inserts as well as misses. The caliper system compensates for a wide range of variables and countered in conventional newspaper inserting machines operating at 400 cycles per minute. The set-up of the caliper system is highly simplified due to the system software which, in addition to while proving a learn zero and learn insert mode, further recognizes operational variables which occur during operations such as fluctuation of paper basis weight and ink build up on the caliper wheel. The system provides self-checks to verify operational accuracy.

38 Claims, 12 Drawing Sheets

PRECISION CALIPERING SYSTEM

FIELD OF THE INVENTION

The present invention relates to calipering systems for monitoring the delivery of inserts to a gathering or inserting apparatus and more particularly to a novel calipering system including software and hardware for assuring and maintaining caliper accuracy, providing automated setup and providing information for inventory control and for assuring insert zoning accuracy.

BACKGROUND OF THE INVENTION

Learn-mode calipers have been in service for several years in the book binding industry for monitoring the flow of inserts from a hopper to a gathering machine. However, such prior art systems have been limited to the capability of indicating either a "miss" or a "multiple feed" in addition to providing an indication of a "normal feed".

Such systems lack the capability of providing specific and accurate multiple feed operations such as recognizing simultaneous feeding of two, three, four, five or more inserts.

In addition, present day systems lack the capability of simplified setup of the calipering system as well as maintaining continuing accuracy regardless of ink build-up on the caliper roll and changes in paper basis weight.

BRIEF DESCRIPTION OF THE INVENTION

The present invention is characterized by comprising hardware which incorporates a dual caliper range technique to further enhance the caliper accuracy through the employment of the first and second caliper ranges each being designated for measuring a predetermined thickness range, such as 0.003 inches to 5/16th inches and 5/16th inches to 5/8th inches using only one proximity sensor.

The calipering system has two operating modes namely a "learn zero" mode and a "learn insert" mode. Operating mode selection is obtained through operation of a 3-position manual selector switch. When "learn zero" is selected, the hopper is cycled without feeding inserts to adjust the zero position of the caliper.

Thereafter, prior to feeding the first single insert, the switch is moved to the "learn insert" position and is maintained in this position until a new insert is re-learned. During the "learn insert" mode, the calipering system is automatically adjusted to the single insert being fed.

The third switch position is reserved for a "calibration" mode. During regular calipering operation, this position is passive and calibration will be activated if the proper procedure is not followed.

On occasions when the learn mode caliper may have to be recalibrated or in the event the calibration check is desired, the hopper is jogged to activate the timing proximity sensor and the three position switch is moved to the "calibrate" position. Light indicators provided as part of the control panel provide either a flashing indication to advise the operator that the caliper is properly calibrated or other light indications which indicate that the caliper requires calibration and pointing out which caliper component is at fault.

The learn sequence is both simple and rapid and is initiated by assuring the first insert fed into the hopper is a single insert which generates an analog insert value to be used by the caliper control program to set the preliminary target values for miss, single, double, triple, etc. As the first insert is "learned" the caliper program warns the operator if the first insert is above or below the caliper operating range.

The control program makes preliminary target computations which are based on parameters that are fixed real numbers which originate from empirical testing and are determined as a function of insert thickness and represent the insert boundaries. As an example, assuming that it is possible to run a one inch insert, the parameters for "one single feed" would be 0.5 inches and 1.8 inches, i.e. if a measurement of below 0.5 inches is made, this is considered a miss and if a measurement of above 1.8 inches is made this is considered to be a double.

"Seeds" are generated by an algorithm following the first single feed. The caliper program stores the value of the second and third single inserts during the learn sequence. The values for these second and third inserts must be within 10% of the first value recorded by the caliper program. When the three inserts are recorded, the caliper program generates an average single insert (i.e. the three recorded insert measurements are averaged and this is the "seed" employed to refine the preliminary target values).

The software provides a continuous insert revision wherein the insert "seed" changes constantly to preserve caliper reading integrity which may be altered due to insert thickness variations within a batch. Seeds for inserts ranging in thickness from three to thirty thousandths of an inch are updated every 20 single feeds. Seeds for inserts between 30 and 60 thousandths of an inch thick are updated every 10 single feeds. Seeds for inserts between 60 and 120 thousandths of an inch thick are updated every 5 single feeds and seeds for inserts above 120 thousandth of an inch thick are updated every time a single insert is recorded.

The system provides a continuous zero insert update which continuously updates the zero insert associated with inserts thinner than 80 thousandth of an inch. The update is designed to compensate for any "hopper drum growth" due to such factors as heat expansion that could result in potential accuracy losses.

The zero insert update is activated after a miss if the offset air cylinder is not energized when the zero update is activated. The caliper program stores mis-values in groups of twenty and then averages the values. If the average values are over plus or minus one thousandth of an inch of the original zero base then the original base is updated, otherwise it is left unchanged.

The caliper system is provided with a cushioned stop for eliminating noise generated by the caliper when running thicker inserts. The cylinder is activated automatically by the caliper program when running inserts thicker than 80 thousandth of an inch or when the hopper is inhibited for six cycles, and is maintained activated until the inhibit is cancelled.

The caliper software program provides for the display of various types of performance data as well as access to the various caliper parameters, variables and seeds used in the algorithms and further provides real time product count by station, per zone, for: miss, 1, 2, 3, 4, 5 or greater insert feeds and the total count polled per hopper, and per zone, having a current capability of up to 10 thousand packages.

The software, in addition to performing all of the above functions, performs a number of electronic tests which insure perfect calibration throughout operation of the caliper system.

OBJECTS OF THE INVENTION

It is therefore one object of the present invention to provide a novel caliper system for monitoring inserts delivered from a hopper and identifying with precision the nature of the delivery during each operating cycle (i.e. "missing", "single", "double", etc. feeds).

Still another object of the present invention is to provide a novel caliper system which includes hardware for "learning" an initial caliper setting in the absence of an insert feed.

Still another object of the present invention is to provide a novel caliper system which includes hardware for "learning" an initial insert thickness setting in the absence of an insert feed. Still another object of the present invention is to provide a novel caliper system employing dual caliper detection ranges for detecting distinct but adjacent thickness ranges by a single proximity sensor which greatly enhances the accuracy of the caliper system.

Still another object of the present invention is to provide a novel caliper system utilizing software for continuously updating operating parameters to compensate for any changes in paper thickness, ink buildup and the like.

Still another object of the present invention is to provide a novel caliper system utilizing software which performs a plurality of electronic tests during regular intervals to assure proper calibration throughout the calipering operation.

Still another object of the present invention is to provide a novel calipering system which, in addition to providing accurate data regarding the precise nature of inserts delivered during each cycle of operation, further provides data to assist in the evaluation of targeting zones in various types of performance data and parameter data.

BRIEF DESCRIPTION OF THE FIGURES

The above as well as other objects of the present invention will become apparent when reading the accompanying description and drawings, in which.

DETAILED DESCRIPTION OF THE INVENTION AND PREFERRED EMBODIMENTS THEREOF

Figure 1:
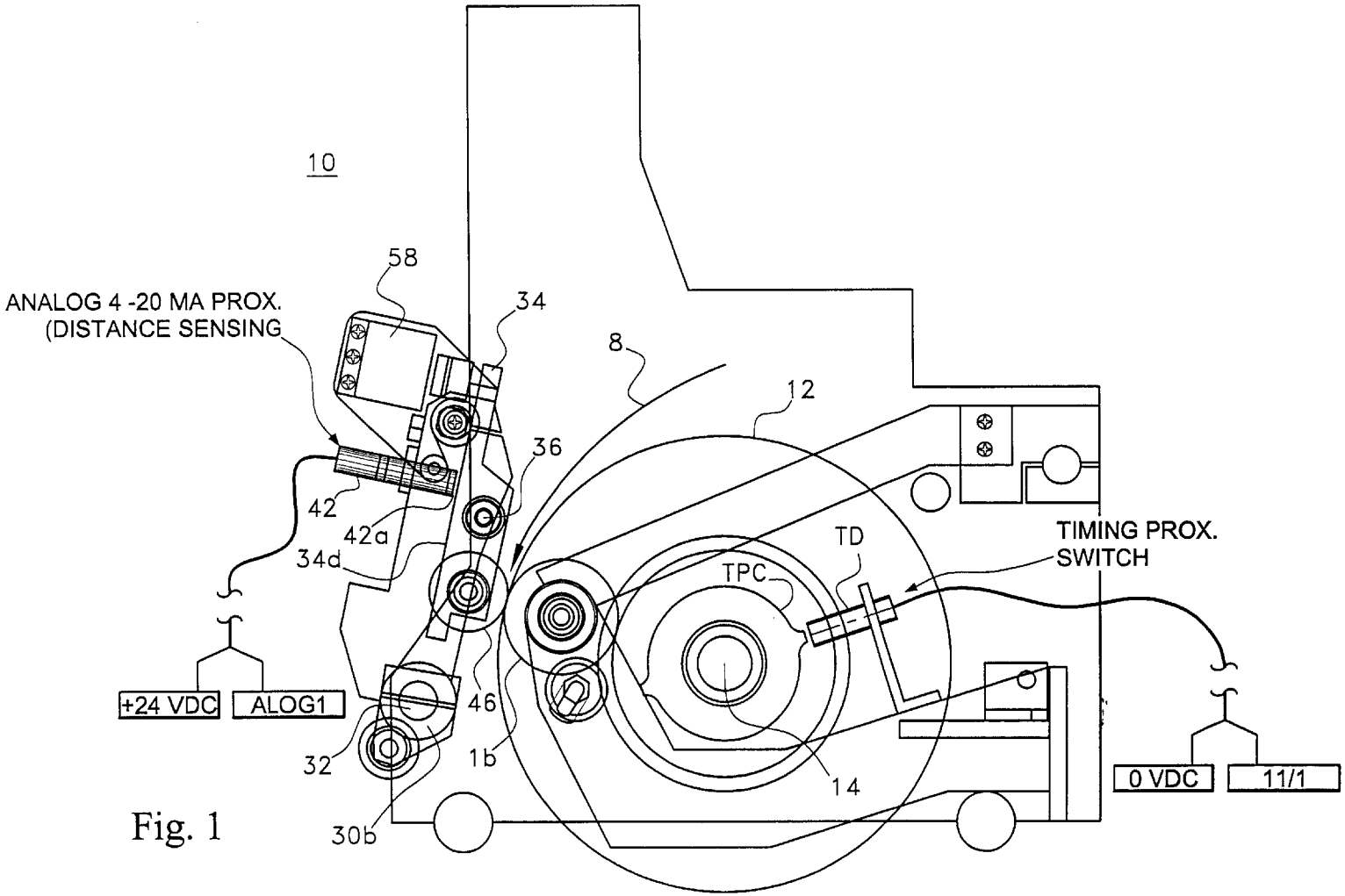
FIG. 1 shows an end elevational view of a caliper system embodying the principles of the present invention.

Making reference to FIGS. 1 through 5, there is shown therein a calipering system 10 ofthe present invention. The calipering system 10 is mounted upon an insert handling apparatus which includes a rotor drum assembly 12 provided with conventional grippers and suckers (not shown), to hold inserts as they are fed in the direction shown by arrow B of FIG. 1, into a gatherer, as is conventional. One typical system for handling inserts is the SLS hopper (manufactured by GMA) which is comprised of an inserter drum assembly 12 mounted to rotate about a shaft 14 represented by a dot dash center line in FIG. 3. The inserter drum assembly 12 has a central region positioned between two outer disc-shaped portions 12*a*, 12*b*. The central region 12*c*, is of a reduced diameter and although not shown, but as is conventional, is provided with first and second grippers, one of which, G, is shown in schematic fashion in FIG. 3. The grippers are arranged at 180° intervals about drum assembly 12. Inserts moving into the inserter apparatus 10 enter at the position shown by arrow A and a leading edge of an insert enters into the gripper, such as, for example, the gripper G shown in FIG. 3, when the gripper G of the drum assembly 12 is at the "twelve o'clock" (i.e., top-most) position. A sucker (not shown) which is fed with a suitable vacuum, draws the insert against the drum and cooperates with the gripper G to carry an insert in the direction of arrow B (FIG. 1) about the drum assembly 12 until the gripper G reaches the "eight o'clock" (i.e., bottom-most) position, at which time the gripper G opens enabling the signature to move in a substantially vertical direction and to move in the direction shown by arrow C. At this time, the other gripper of the gripper pair is at the ten o'clock position receiving the next insert. A typical hopper of this type handles inserts at the rate of 400 per minute.

The novel calipering system 10 is designed to be easily and quickly added to the conventional insert handling apparatus, the portion of the insert handling system shown being limited for simplicity to that portion which is directly related to the calipering system.

A cam 16 is mounted upon shaft 18 (see FIGS. 1 and 3) and is freely rotatable thereon. A toothed sprocket 16*a* is integrally joined to cam 16 and is provided for rotating the cam, as will be set forth hereinbelow. The cam has a low point, 16*b*, and gradually increases in radius from low point 16*b* to high point 16*c* after which the cam abruptly moves along a drop off portion 16*d* back to the low point. Cam 16 is utilized during the insert measuring phase of a calipering system, as will be more fully described.

Toothed drive sprocket 20 is mounted upon shaft 14 and rotates therewith. The toothed drive sprocket 20 is preferably formed of two sprocket halves, 20*a*, 20*b*, to facilitate its mounting upon the shaft 14 without the need to disassemble the hopper assembly.

An idler sprocket 22 mounted upon shaft 22*a* is provided with a pair of parallel flats which slidably engage the opposing linear sides of an elongated slot 24*a* provided in a lower support arm 26 which is utilized to support various components of the calipering system 10 upon the insert handling apparatus.

A drive chain 28 is entrained about the toothed drive sprocket 20, cam sprocket 16*a* and idler sprocket 22. Drive sprocket 20 rotates in a counter-clockwise direction and counter-clockwise rotation is imparted through drive chain 28 to cam sprocket 16*a* and idler 22. The idler 22 is provided with fastening members to secure the shaft 22*a* at a position along the elongated slot 24*a* in support 26 so as to maintain the drive chain 28 taut.

A vacuum disc 31, which is conventional in hopper of SLS type, control the delivery of vacuum to the aforementioned suckers to provide vacuum to a sucker to facilitate pulling a signature or insert into the path. The gripper then pulls the signature of insert from the twelve o'clock position to the eight o'clok position, as is convention.

A caliper arm 30 (FIG. 2) is mounted upon shaft 32. The lower end of caliper arm 30 is provided with a semi-circular clamping portion 30*a*, which cooperates with a semi-circular clamping portion 30*b* to clamp caliper arm 30 to shaft 32 so that caliper arm 30, once its angular orientation is set, does not either rotate about shaft 32 or move linearly therealong.

A pivot arm 34 is rotatably mounted upon shaft 36 which is mounted in an opening 30*c* in caliper arm 30. Pivot arm 34 pivots about shaft 36 which extends into opening 34*b* in pivot arm 34. A circular-shaped recess 34*a* along the rear surface of pivot arm 34 seats the right-hand end of a spring 38, which is under compression and which has its left-hand end seated within a similar circular-shaped recess 40*a* in plate 40, which is secured to a rear surface of caliper arm 30 by suitable fasteners extending through openings 40*b* in plate 40 and threadedly secured to threaded openings 30*d* in caliper arm 30.

In the small gap position the pivot arm engages a stop member 37 having an integral shaft 37*a* (FIG. 2) inserted into opening 30*f* in caliper arm 30.

A proximity sensor 42 is adjustably mounted upon plate 44 which is secured to a rear surface of caliper arm 30 near an upper end thereof, suitable fasteners passing through openings 44*a* in mounting plate 44 and threadedly engaging openings 30*e* in caliper arm 30.

Sensor 42 generates an analog voltage representative of the thickness of an insert (or multiple inserts) passing between caliper bearing 46 and cam 16. The insert urges bearing 46 away from the high point 16*c* of cam 16, rotating pivot arm 34 clockwise. The portion 34*d* of pivot arm 34 above the pivot shaft 36 moves away from the right-hand end 42*a* of sensor 42. The gap therebetween represents the thickness of the insert (or inserts). Although the pivot arm swings about an arc whose center is pivot shaft 36, the small angle of the arc does not degrade accuracy of the thickness measurement.

The caliper bearing 46 is mounted upon a suitable shaft extending through caliper bearing 46 and secured within an opening 34*c* in pivot arm 34. Caliper bearing 46 is free-wheelingly mounted upon pivot arm 34 and rollingly engages the cam surface of cam 16 or an insert passing therebetween. Compression spring 38 normally urges pivot arm 34 counter-clockwise about pivot arm shaft 36 to maintain caliper bearing 46 in rolling engagement with the cam surface of cam 16.

A solid mounting block 48 is secured to the left-hand surface of caliper arm 30 by suitable fastening means provided in a pair of openings 30*f* in caliper arm 30 and threadedly engaging openings 48*a* in block 48. A locking block 50 is secured to block 48 by suitable fasteners extending through openings 48*b* and threadedly engaging openings 50*a* in member 50. Member 50 secures pivot arm 34 against movement along shaft 36, whose free end is seated within a circular recess 50*b* in locking arm 50.

A mounting bracket 52 comprised of a bracket plate 54 secured to the upper end of caliper arm 30 and having a bracket plate 56 secured to its left-hand end, supports a pneumatic cylinder 58 thereon by suitable fasteners extending through openings 56*a* and threadedly engaged in openings 58*a* in pneumatic cylinder 58. A piston arm 58*c* is operated by pneumatic cylinder 58 to position pivot arm in either of two angular positions dependent upon the thickness range of inserts being delivered to the inserter drum 12. In the position shown in FIG. 1, the piston arm 58*c* of pneumatic cylinder 58 assumes a left-hand-most position causing the lower end of the pivot arm 34 to move the caliper bearing 46 to a position closer to cam 16. When the inserter drum 12 is handling inserts within the larger thickness range, pneumatic cylinder 58 is operated to urge piston arm 58*c* to the right-hand-most position, thereby moving the caliper bearing 46 a given distance away from cam 16. In one typical embodiment, the small gap region has a thickness ranger of 0.003" to 5/16" and the larger gap range is 5/16" to 5/8". However, other gap ranges may be provided as desired.

Figure 4:
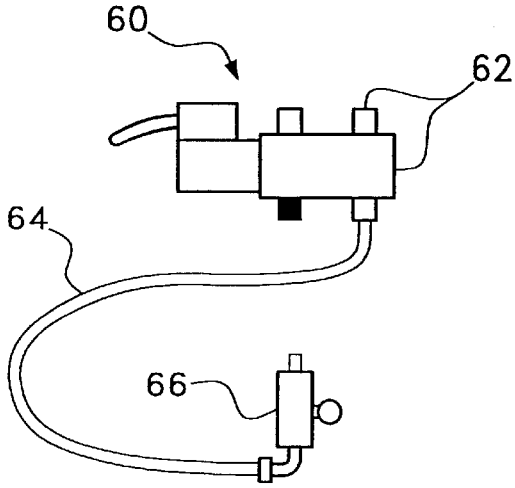
FIG. 4 is a simplified view of the control for the pneumatic cylinder employed in the positioning of the caliper bearing shown in FIG. 2.
Figure 5:
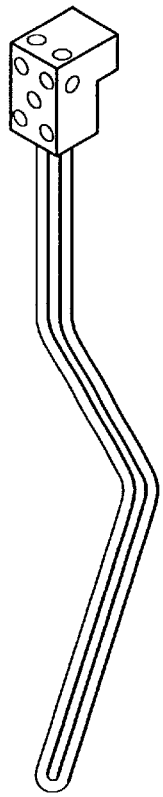
FIG. 5 is a perspective view showing a guide employed in the calipering system of FIGS. 1–3.

FIG. 4 shows the valve control for pneumatic cylinder 58 and is comprised of a solenoid 60 which controls the feeding of pressurized air to airhose 64 by way of an air valve 62 controlled by solenoid 60 so as to apply air under pressure through hose 64 to coupling 66 having a fitting joined to one of the fittings 58*b* of pneumatic cylinder 58 wherein the control valve, in the first position applies air under pressure to one of the fittings to move the piston arm to the left and applies air under pressure to the other of the fittings to apply air under pressure to the other fitting to move the piston arm to the right, depending upon the thickness range of the inserts being handled.

The movement of inserts about the drum assembly 12 tends to cause the inserts to experience some fluttering and instability as they move around drum assembly 12 for counting and thickness measurement purposes. To stabilize the inserts as they move about drum 12 from the twelve o'clock position to the eight o'clock position, a carry down roller assembly is mounted upon shaft 32 and is comprised of two substantially semi-circular mounting members 70*a*, 70*b*, which are clamped about shaft 32. A carry-down roller arm 72 is pivotally mounted to lower mounting member 70*b* by a shaft means shown schematically as 74 and extending into opening 72*a*. A roller 76 is pivotally mounted to a shaft shown schematically at 78, which shaft extends into an opening 72*b* in carry-down roller arm 72. Inverted, substantially U-shaped bracket 80 is secured to carry-down roller arm 72. A roller 36*a* arranged at the right-hand end of shaft 36 is captured within inverted U-shaped member 80. Roller 76 is positioned upstream of caliper bearing 46 and serves to prevent a sheet from moving away from the periphery of the drum as it moves from the twelve o'clock position toward the measuring region between caliper bearing 46 and cam 16.

The cam 16 is adjusted so that its high point 16*c* is in rolling engagement with caliper bearing 46 (assuming that no insert is passing there between) when the leading edge of an insert has passed beyond the measuring point and typically in the range of from 3½ to 6½ inches behind the leading edge of the insert. The calipering system of the present invention is adapted to handle inserts having a length measured in the feed direction in the range from 4 inches to 14 inches. Shorter inserts are thus measured once. However, longer inserts are measured twice as they move counter-clockwise from the twelve o'clock position to the six o'clock position.

The Accu-Count System, which includes system hardware as well as software, provides the means to "count" the number of inserts pulled each cycle from a hopper on an inserting machine, such as a GMA SLS Newspaper Inserting Machine. This is a significant enhancement compared to conventional Calipering Devices which provide a "miss" and "multiple" output for newspaper operations which are developing a Mailroom Master Control involving inventory management and accountability.

To provide the "counting" capability, the accuracy of the Calipering System is assured through the use of a very precise mechanism as shown in FIG. 1. In addition, the system, through its software and hardware, provides the means to compensate for a wide range of variables associated with a conventional Newspaper inserting Machine operating at 400 cycles per minute.

The Caliper System has been designed to be very simple to set-up. It compensates for operational variables which may occur during operation such as fluctuation of paper basis weight and ink build-up on the Caliper wheel 46.

In addition, a major benefit of the Calipering System is that it contains a wide range of capabilities to conduct self checks and to provide information to verify operational accuracy. This capability is particularly relevant as it provides operators with the ability to verify that the Caliper is performing properly. The complexity of the overall Control System necessitates that there be means to isolate and identify performance characteristics.

The Accu-Count Calipering System is an integrated hardware and software system. Reliability is maintained through self compensating systems. Operator set-up is minimized through enhanced logic as well as the basic mechanical simplicity of the caliper design. The device is readily integrated with any host inventory/Master Control System.

The Caliper System has the capability to:

Ensure greater insert zoning accuracy (insert).

"Multiple" distribution reporting.

Faster insert set-up.

Continued calipering accuracy throughout a zone/run.

Inventory control informational generation.

Master Control System capability for multiple inserters.

Figure 6:
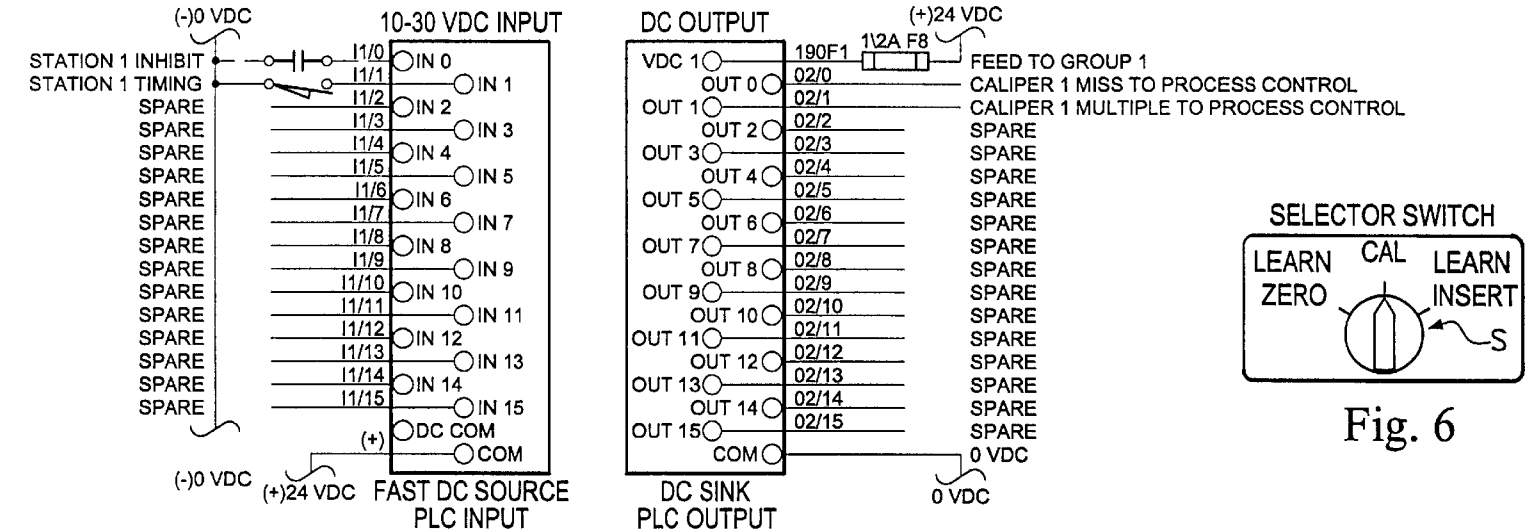
FIG. 6 shows the selector switch for the caliper system of FIG. 1.

Caliper operating mode selection. The Caliper has two operating modes: (1) "learn zero" and (2) "learn insert". Operating mode selection is accomplished by a three-position manual selector switch S (see FIGS. 6 and 8) preferably located on top of each hopper. At the start of every learn sequence, the selector switch S is positioned on "learn zero." The hopper is cycled without feeding inserts. Then, prior to feeding the first single insert, the switch is positioned on "learn insert." The switch remains in this position until a new insert is re-learned.

The third switch position is reserved for "calibration." During regular Caliper operation, this position is passive and calibration will not be activated if the proper procedure is not followed (refer to the calibration control feature).

Rapid learn sequence. Upon initializing the caliper learn sequence, the newspaper inserting machine operator needs to ensure that the first insert fed into the hopper is a single feed. The first single feed detected by sensor 42 generates an analog insert value to be used by the caliper control program to set preliminary target values for miss, single, double, triple, etc. As the first insert is learned, the caliper program will warn an operator if it is above, or below, the caliper operating range.

In the control program, preliminary target computations are based on (1) parameters and (2) seeds. Parameters are fixed real numbers that originate from empirical testing. They are determined as a function of insert thickness and represent insert boundaries. For instance, if it was possible to run a one-inch insert, the parameters for "one single feed" would be 0.5 and 1.8: below 0.5 inch it is a miss and above 1.8 inches it is a double.

By contrast, seeds are generated by an algorithm. Following the first single feed, the caliper program stores the second and third single inserts of the learn sequence. The values for these second and third inserts must be within 10% of the first value to be recorded by the caliper program. Once these three inserts are recorded, the caliper program generates an average single insert—the "seed"—which is used to refine the preliminary target values.

Continuous insert revision. The insert seed changes constantly to preserve caliper reading integrity in light of possible insert thickness variations within a batch. Seeds for inserts ranging in thickness from 3 to 30 thousandths of an inch are updated every 20 single feeds, seeds for inserts between 30 and 60 thousandths of an inch thickness are updated every 10 single feeds, seeds for inserts between 60 and 120 thousandths of an inch thickness are updated every 5 single feeds and seeds for inserts above 120 thousandths of an inch thickness are updated every time a single insert is recorded.

Continuous zero insert update. The caliper continuously updates the zero insert associated with inserts thinner than 80 thousandths of an inch. This update is designed to compensate for any "hopper drum growth" that could result in potential accuracy losses.

The zero insert update is activated after a miss if the offset air cylinder is not energized. When the zero update is activated, the caliper program stores miss values in groups of twenty, then averages the values. If the averaged values are within±one thousandth of an inch of the original zero base, then the original base is updated; otherwise it is left unchanged.

Noise control. An air cylinder 58 (FIG. 1) with a cushioned stop is used to eliminate caliper generated noise when running the thicker inserts. The cylinder 58 is activated automatically by the caliper program for inserts thicker than 80 thousandths of an inch or when the Hopper is inhibited for 6 cycles, until the inhibit is canceled.

Retrievable performance data. The caliper program displays the various types of performance data and access to the various caliper parameters, variables and seeds used in the algorithms and provides real-time product count by station, per zone, for miss, one, two, three, four, five or greater insert feeds; and the total count pulled per hopper and per zone (currently up to 10,000 packages).

Calibration control. On occasion, the learn mode caliper may have to be recalibrated or the calibration checked. A feature included in the caliper program facilitates calibration-related operations. At the heart of this feature is a command routine energizing the hopper lights according to a sequence designed to provide operator feedback, which greatly facilitates calibration.

Figure 7:
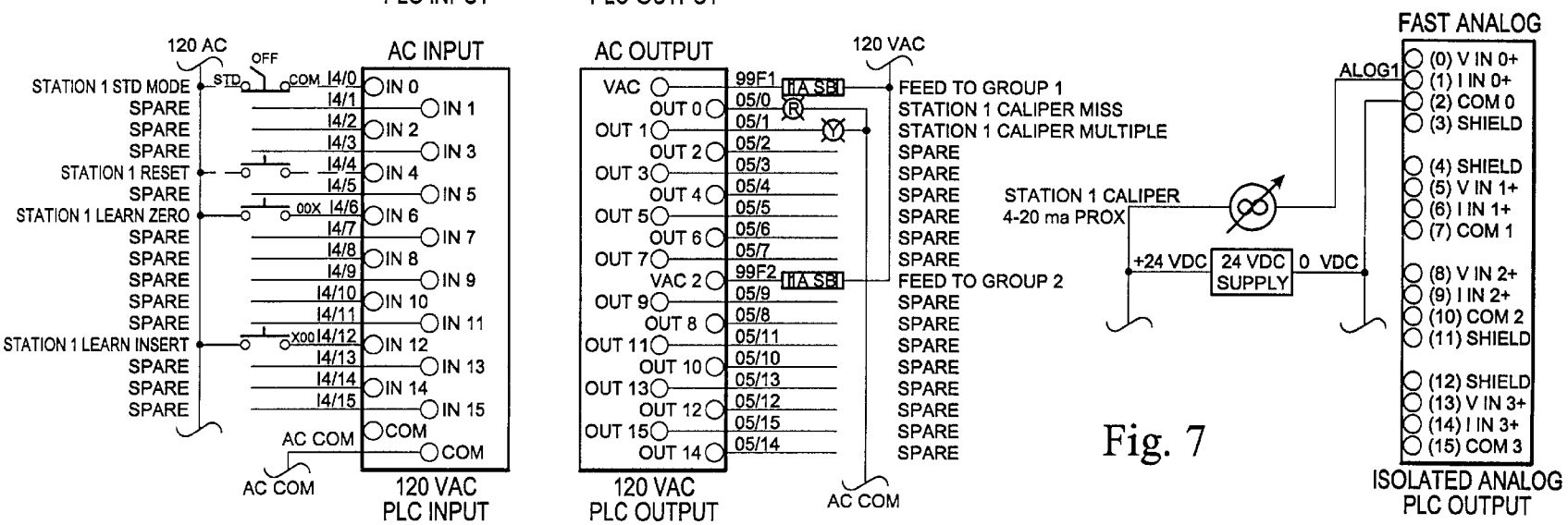
FIG. 7 is a simplified schematic diagram of the electronic system for controlling the calipering system, including the caliper assembly of FIGS. 1–6.
Figure 8:
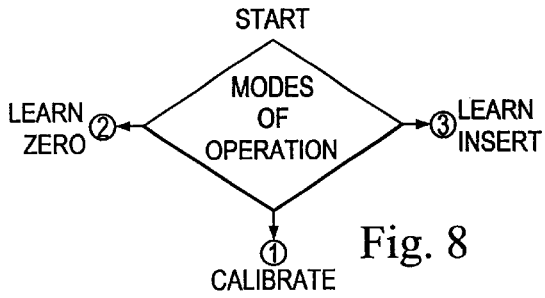
FIGS. 8 through 15 are flow diagrams for explaining the various operations of the caliper system.

To launch the calibration procedure, an operatorjogs the hopper drum until the timing proximity switch TD is activated (proximity red light is on), and then turns the three position mode switch S from either "learn zero" or "learn insert" position to the "calibrate" position (see FIG. 8). Turning the switch energizes the two hopper lights L1 and L2 (see FIG. 7). Two lights L1 and L2 flashing together mean that the caliper is properly calibrated; other light combinations indicate that the caliper requires calibration and point out which caliper component is at fault as set forth in the detailed description hereinbelow.

Figure 9:
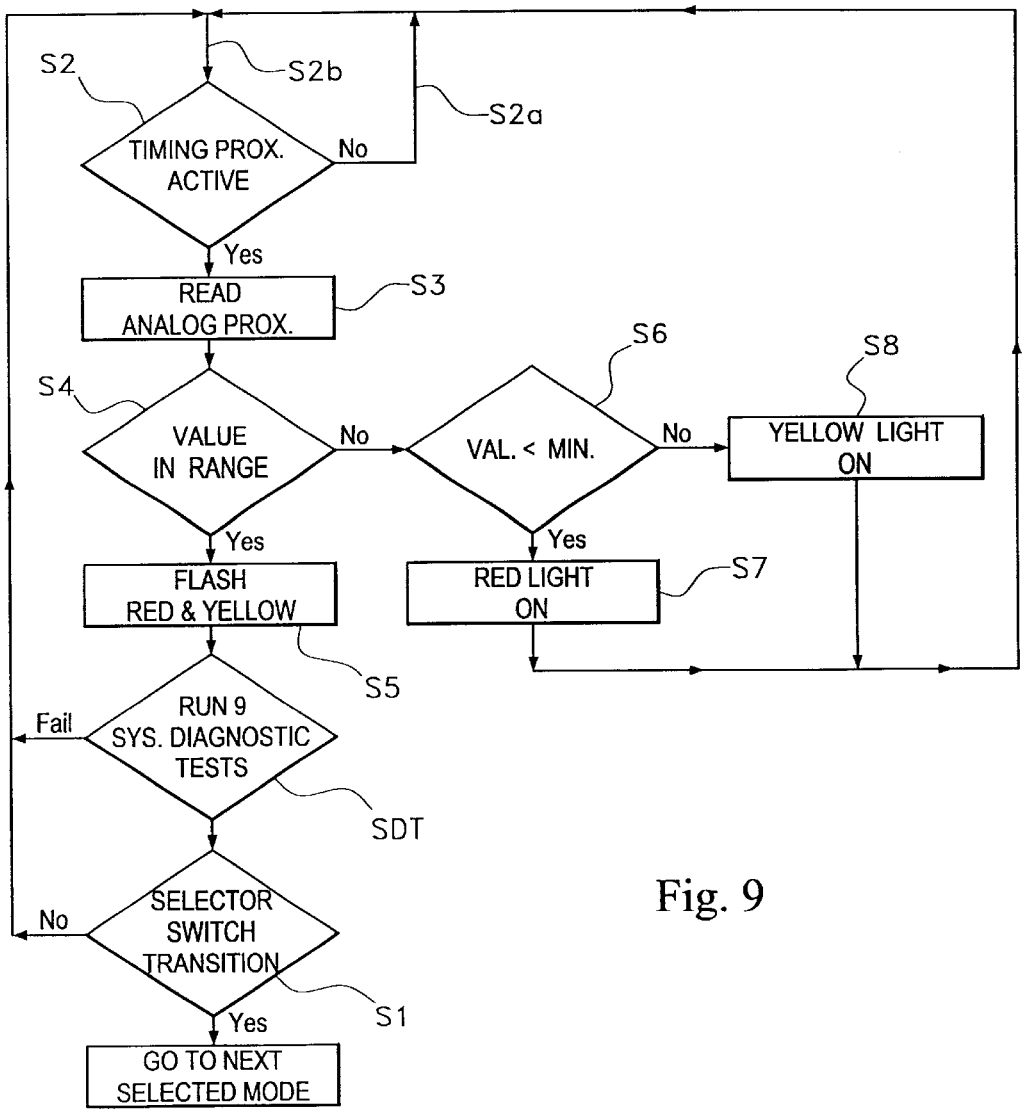

In addition to the lights L1, L2, nine electronic (step SDT—FIG. 9) tests are provided to ensure perfect calibration throughout Caliper operation, namely:

1. Timing proximity Integrity test. This test checks the timing proximity switch signal;
2. Analog proximity Wiring test. This test checks for minimal analog proximity signal (to avoid broken wires);
3. Caliper zero base setting test. This test checks if the zero base falls within the desirable range during the second cycle of an extended exhibit (this test is blocked during the use of the offset solenoid);
4. Minimum analog movement test. This test looks for a 2 thousandths of an inch loading at all times, except during the use of the offset mode. The minimum analog movement test prevents anyone from moving the Caliper back; i.e. prevents bypass.

Drum out of round test. This test compares the A gripper zero reading base to the B gripper zero reading base, during the second and third empty gripper cycles, while the Caliper 46 is inhibited. The two readings have to be withing three thousandths (0.003) to pass, failure indicates a bent main shaft or bad bearings.

6. Insert failed to pull test. This test looks at how long it takes to learn an insert after the learn mode has begun, the Hopper has one drum rotation to learn the insert before the test fails.

7. Not-correct zero base test. This test would fail if someone tried to pull inserts when the selector switch is on zero learn. Also, the test would fail if there were four failures because the zero base was out of calibration range during a "learn zero" sequence.
8. Total analog exceeded test. This test would fail during the learn sequence if a reading was above the upper reading range limit.
9. Offset not in range test. This test looks for offset displacement to be within a predetermined range.

OPERATIONAL SPECIFICATIONS FOR AN SLS INSERTER

PREFERRED EMBODIMENT

| Insert Multiple Specifications: | |
|---|---|
| Maximum Operating Speed: | 400 CPM |
| Insert Format: | |
| Head to Foot "width" | Min. 7.5" (Centered on Pocket) Max. 15" |
| Front to Back "height" | Min. 5.5" Max. 11.5" |
| Minimum Product Thickness (single sheet): | .003" |
| Maximum Product Thickness (jacket): | .180" |
| Maximum Thickness Measurement Range: | .625" |
| Maximum Throw of Caliper: | .680" |

(Maximum allowable deflection of Caliper Arm for products to pass through)

Overage Detection Range:

| Thickness | Maximum Count |
|---|---|
| <.03" | 5 |
| <.09" | 4 (quad) |
| <.13" | 3 (triple) |
| >.13" | 2 (double) |

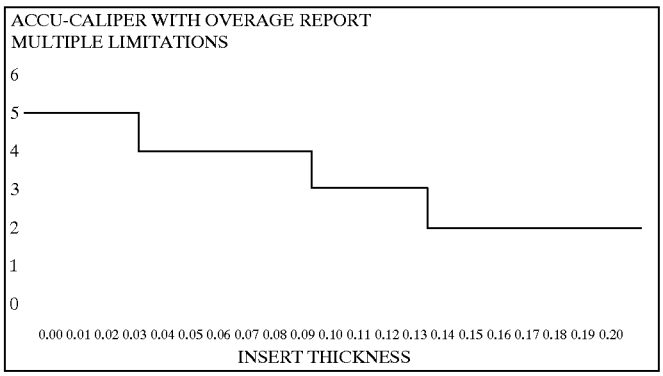

| | |
|---|---|
| Maximum number of Inserts Detected: | 5 |
| Target Count Accuracy: | 99% |

FUNCTIONAL DESCRIPTION

Component Overview

A rigid, steel plate construction consisting of upper and lower assemblies.

A chain drive 28 to the calipering cam 16.

Thickness sensing wheel assembly including precision bearings 36, support arm 30 and spring loading 38.

Automatic offset mechanism (solenoid 58) for thick inserts and extended inhibit cycles.

Sensor 42 for detecting insert thickness.

Timing sensor TD and target for defining where the insert is calipered (FIG. 1*a*). The timing target is attached to the drive pulley to provide easy adjustment, if desired.

SLC500 Based Logic (manufactured by Allen-Bradley) for processing the calipering information for four (4) calipering devices (see FIG. 7). However, any other suitable programmable logic controller may be used.

Two segmented lights L1, L2 aid in set-up and verification of learned values.

Pre-lift wheel to reduce the bounce associated with ramping up on the product.

Specifications for the Calipering System Include:

Learn Mode with one (1) insert after the Learn Mode is initiated. The average of the first three (3) good inserts becomes the initial nominal thickness.

Ability to determine the number of inserts in the gripper (up to Qty. 5).

Update capability consisting of processing the average thickness every fiftieth ($50^{th}$) good insert.

The Learn Mode Caliper 10 can communicate with a higher level controller through a data highway port on the SLC504 Processor manufactured by Allen-Bradley (however, any other suitable controller of comparable capability may be used). The actual number of inserts in any given grouping can be accessed by the Master Control System.

The caliper incorporates safeguards against operator defeatibility.

The mechanical portion of the caliper 10 is able to be retrofitted with almost no modifications to existing hoppers and can be connected in less than four (4) hours.

ACCU-COUNT CALIPER SOFTWARE FEATURES

The Accu-Count Caliper software features include:

1. Less than 5.0 millisecond average update time.
2. Single proximity input per hopper 3. Multiple tables to study system response.
4. Express learn feature.
5. Automatic miss/double ranging.
6. Simple initial set up using lights.
7. Calibration check.
8. Learn zero mode with light test and verification.
9. Insert learn with multiple tests and verification.
10. Calculated number of inserts per gripper.
11. Totalized cycles, inserts, miss and doubles.
12. Integrated and tested with PHE mechanical caliper.
13. Auto re-learn to continually adapt to varying thickness, ink build-up and temperature.
14. Automatic offset determination saving mechanical wear and enhancing thick insert performance.

CALIPER INITIAL SET-UP

The caliper system uses a 2 segmented indicator light system employing lights L1, L2 (see FIG. 7), to set both proximity clearances and the caliper wheel interference level at the base point.

1. An operator jogs the hopper until the timing mark on the caliper cam is aligned to the point 16*d* (FIG. 3) in the insert where the desired calipering point is. The timing mark TM can be viewed from the side of the cam and is a line radiating from the center of cam 16. Cam 16 is moved by loosening the split gear 20, driving it from the main shaft of the hopper. This should be 3.5 to 6.5 inches behind the leading edge of the insert. The gear is re-tightened if it has been moved.

The timing proximity switch TD (see FIG. 1) is located on the drive side of the hopper, close to the hopper main shaft 14. The clearance between the proximity and the target should be between 0.020–0.030 inches. While the hopper is at the caliper cam aligned position, the timing proximity cam TPC is rotated in the direction ofrotation (counter-clockwise) until the LED indicator LED 1 connected to the proximity switch TD just illuminates. The TPC cam is rotated by loosening the clamp collar holding the cam to the hopper main shaft 14.

The hopper rotates in a clockwise direction as viewed from the drive side. The timing cam is backed up until the LED indicator just goes off. Any assemblies loosened during adjustment are re-tightened.

3. The clamp holding the learn mode caliper assembly to the shaft is loosened. The assembly is backed out so that it does not touch the calipering wheel 16 (FIG. 1).

4. The calibrate mode is selected by moving the selector switch S to the full right position, and then to the center ("calibrate") position (see FIGS. 6 and 8). Lights L1, L2 will illuminate for 2 seconds to verify the operation of the light system.

5. The initial placement of the caliper analog proximity switch 42 is set by loosening the fasteners holding the proximity switch 42 in place. Ideal placement of the proximity 42 with respect to the target flag is achieved when the red light and yellow light (L1, L2) are both blinking. More specifically, when the calibrate mode is selected (see FIGS. 6 and 8), the program jumps to step S1, FIG. 9. If there is no change in switch position, the program branches to S2. If the timing proximity switch 42 is not active, the program continues to recycle between S2*a* and S2*b*.

When the proximity switch becomes active, a reading is taken at S3 and the analog output of 42 is compared against the upper and lower limits. If the value is within range, S4, the program branches to S5 causing the red and yellow lights (L1, L2) to flash.

If the analog value is outside the range, the program branches to S6 and if less than the lower limit, red light L1 is lit, S7, and the program returns to S2*b* to continue calibration.

If the analog value is not less than the lower limit, the program branches to S8, indicating that the value is above the upper limit and lights yellow lamp L2 and then returns to S2*b* to continue the calibration.

To set the initial placement ofthe caliper mechanical interference, the assembly is moved in toward contact with the calipering cam 16. Ideal placement of the mechanism is achieved when both the red and yellow lights on the light system are blinking at the same time. A solid yellow light indicates the mechanism is too close to the cam. An un-illuminated yellow light indicates the mechanism is too far away from the cam. The clamp collar holding the mechanism is tightened so that the desired placement condition is retained.

7. To set the initial placement of the offset bumper, feeler gauges may be used to set the bumper distance to the caliper arm at 0.185". To check correct placement, the solenoid 58 is manually activated by pressing a button on the top of the solenoid. Ideal placement of the offset bumper is achieved when both the red and yellow lights L1, L2 are blinking alternately. The nut on the cylinder stem is tightened after making sure the bumper face is parallel to the caliper arm 34.

8. The calibrate mode is exited automatically after 5 minutes, moving the hopper past the timing proximity or entering either the learn zero mode or the learn insert mode.

9. The learn zero mode should be actuated at this point to set the electrical zero point to the mechanical zero point.

10. To learn the offset position, inhibit the hopper and jog or run it empty for 6 complete cycles. The cylinder should be extended at this point.

ACCU-COUNT CALIPER CHECK CALIBRATION MODE

The Accu-Count caliper uses the L1, L2 light system to show that the hopper is correctly set up.

1. The hopper is jogged until the timing mark on the caliper cam is aligned to the point in the insert where the desired calipering point is. The timing mark can be viewed from the side of the cam. It is a line radiating from the center of the cam. This is also the point where a correctly timed hopper will have the LED indicator on the timing proximity (located on the drive side of the hopper on the main shaft) just ready to come on. There should be no paper in the gripper.

2. Switch S is moved to the calibrate mode. This can be achieved on this version by moving the selector switch to the full right position, then to the center position. Both L1, L2 illuminate for 2 seconds to verify the operation of the light system.

3. Ideal placement of the mechanism and caliper proximity is achieved when both lights L1, L2 are blinking at the same time. A solid yellow light indicates the mechanism is too close to the cam. An un-illuminated yellow light indicates the mechanism is too far away from the cam. Both lights L1, L2 in the light system should be blinking.

4. The offset solenoid is manually activated by pressing the button on the top of the solenoid valve. The lights L1, L2 will alternately blink if the offset bumper is correctly positioned.

5. The calibrate mode is exited automatically after 5 minutes, moving the hopper past the timing proximity or entering either the learn zero mode or the learn insert mode.

ACCU-COUNT CALIPER LEARN ZERO MODE

The Accu-Count caliper uses light system L1, L2 to show that the hopper has accepted a current zero setting as correct.

1. The hopper is jogged until the timing mark on the caliper cam is aligned to the point in the insert where the desired calipering point is. The timing mark can be viewed from the side of the cam. It is a line radiating from the center of the cam. This is also the point where a correctly timed hopper will have the LED indicator LED 1 (see FIG. 1) on the timing proximity (located on the drive side of the hopper on the main shaft) just ready to come on. There should be no paper in the gripper.

2. Switch S is moved to the calibrate mode. This can be achieved on the preferred embodiment by moving the selector switch to the full right position, then to the center position. Both lights L1, L2 illuminate for two (2) seconds to verify the operation of the light system. Then lights L1, L2 should blink to verify a correct setup. A correct setup is required in order to learn a zero. (refer to the initial setup if this setup is not correct).

3. Switch S is then moved to the learn zero mode. This can be achieved by moving the selector to the far left position. Lights L1 and L2 will be illuminated as a test for 2 seconds, then the L1 and L2 remain on in a solid fashion. The hopper is then rotated. When the low point of the cam is acceptable, lights L1 and L2 will begin flashing. As the hopper continues to rotate, the flashing lights will extinguish as the cam high point is detected within acceptable limits. Both lights on the indicator will go out indicating a correct zero learn.

4. The hopper is now ready for operation. Refer to the learn insert mode to learn a new insert size.

ACCU-COUNT CALIPER LEARN INSERT MODE

The Accu-Count caliper uses a 2 segmented indicator light system (lights L1 and L2) to test the validity of a new insert read with respect to the current setup of the hopper.

1. Begin by pulling inserts with the hopper, and enter the learn mode by moving the selector switch to the far right position. Lights L1 and L2 of the light system will illuminate providing visual feedback that all lights work and the learn mode has been entered. Lights L1 and L2 will remain on after 2 seconds.

2. Ensure the next insert through is a typical example of the insert to be learned. Rotate the hopper through a cycle. If any lights are still on, the learn has failed.

Yellow light failure—This test makes sure that an insert is not above the maximum range of the caliper. Check the hopper for a large wad or jam-up. Try learning again. A second failure may warrant a calibration test to make sure that the caliper is correctly set.

Red light failure—This test makes sure an insert of minimum thickness has been pulled from the hopper. Should the light stay on for a very thin product, try jogging another through. A second failure may warrant a calibration test to make sure that the caliper is correctly set.

3. If both lights have gone out, the insert has been accepted as a valid one. The express learn feature now has set the parameters necessary for running this product. The hopper will now be self-monitoring. The next 2 good inserts passing through the hopper will be averaged into the calculation for typical insert thickness and new tolerances set.

4. Once the express learn has its 3 valid insert data, the data will be updated every 50 good inserts in a ⅓ weighted average. Data will be stored in a table to show the number of inserts in each gripper, along with a total insert count.

Figure 10:
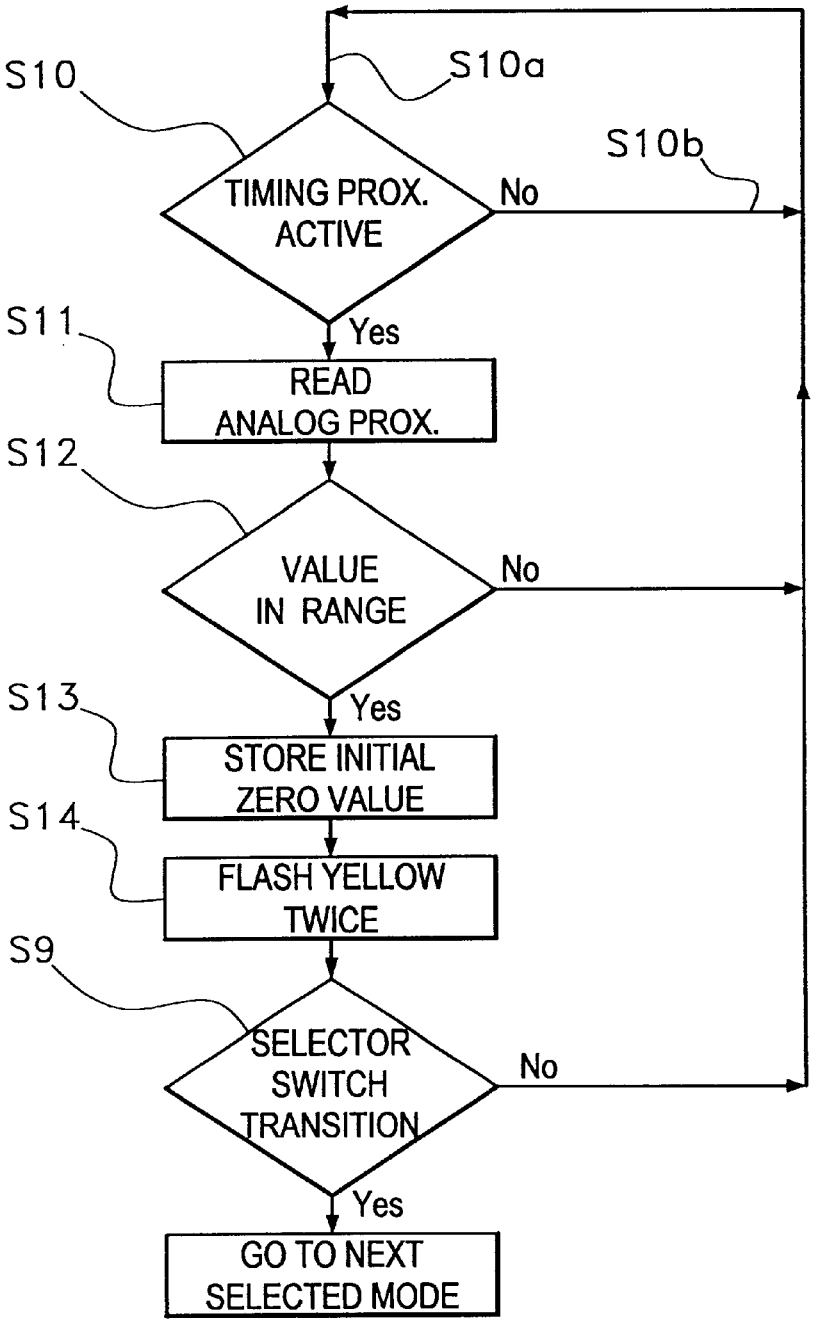

FIG. 10 is a flow diagram of the learn zero mode. When the selector switch S is maintained in the learn zero position, S9, the timing proximity switch is examined, S10. If the proximity switch TD is not activated, the program loops between S10*b* and S10*a*. When the proximity switch TD is active, the analog proximity sensor 42 is examined, S11. If the analog value lies within the permissible range, this value is accepted as the initial zero value, S12*a*, and is stored at S13. If the analog value is not within the acceptable range, the program loops back to S10*a*.

When the initial zero value is accepted, S12, and stored S13, the yellow lamp L1, is flashed two (2) times, S14.

The program then returns to S9. If the switch position has not changed, the program will loop through steps S10 and S9.

If another mode is selected, the program branches to the selected mode.

Figure 11:
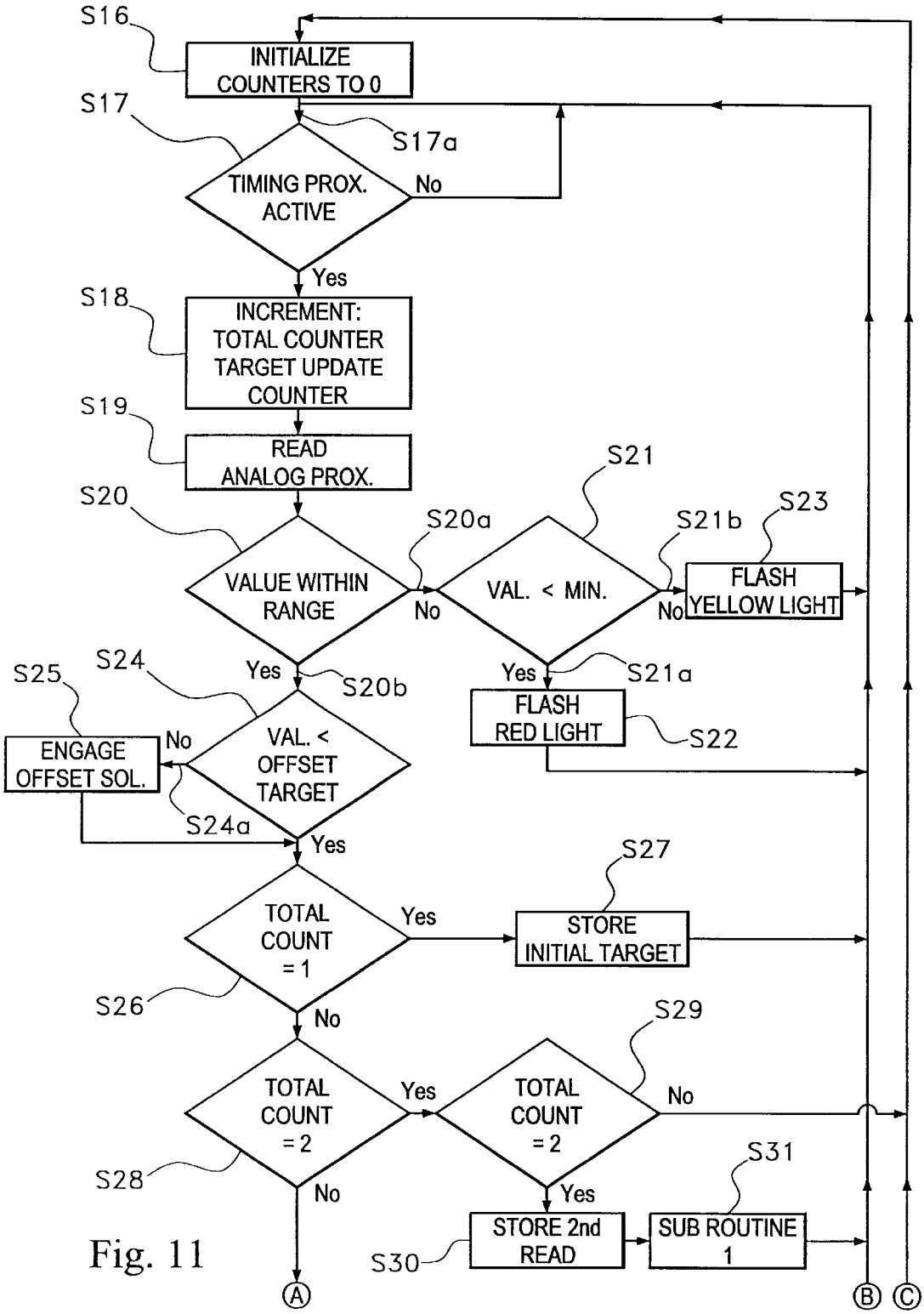
Figure 12:
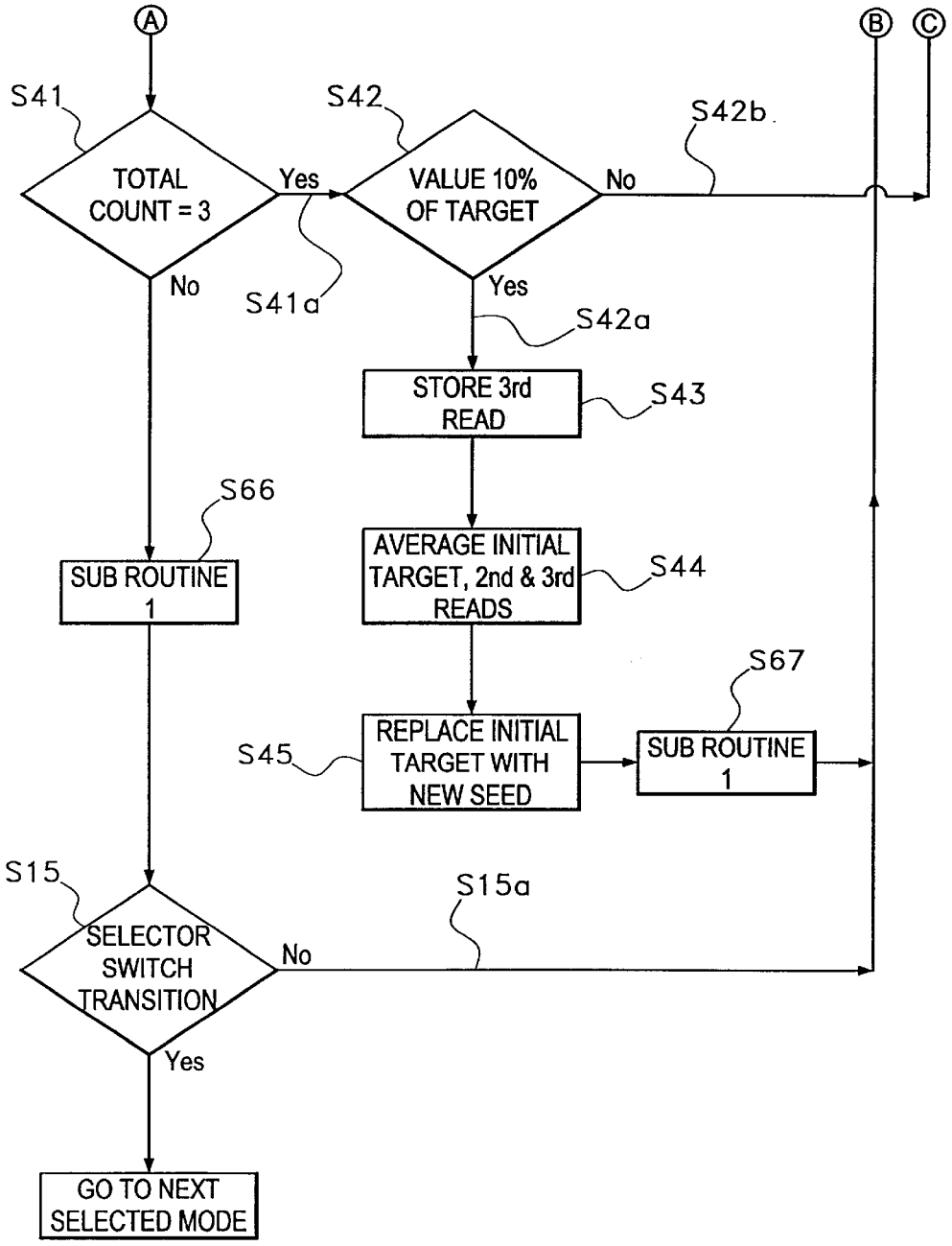

The "learn insert" mode is shown in FIGS. 11 and 12 and entered by switching to "learn insert" directly from "learn zero."

If the selector switch position is retained, S15 (FIG. 12), the program branches to S17 to initialize the counters in the controller to zero. The timing proximity switch is examined at S17 and loops between S17 and S17*a* until the switch TD is active. When active, a total counter is incremented and a target counter is updated (by one count) at S18.

The analog proximity 42 is examined, S19. If the value is out of the acceptable range, S20, and is below the minimum acceptable value, S21*a*, the red light is flashed, S22. If the value is above the maximum acceptable value, S21*b*, the yellow light is flashed, S23. When either light is flashed, the program returns to S17*a*.

When the analog value lies within the acceptable range, S20*b*, the value obtained is examined to determine if it is above or below the offset target, S24. If the analog reading is greater than the offset target, S24*a*, the offset solenoid is engaged, S25, and the program steps to S26(the engaged offset solenoid prepares the proximity switch for handling the larger range of inserts). At S26, a count is developed. If the total count is 1 (i.e., the first insert has been examined), the program branches to S27 to store the initial target, and then returns to S17*a*. Steps S17 through S25 are repeated for the next (second) insert at S26, since the total count is greater than 1, and the program advances to S28. Since the count is 2, (the second insert has been examined) the analog value is examined to determine if it is within ±10% of the target value, S29. If greater than ±10%, the program returns to S16 whereupon the counters are initialized and then steps S17–S29 are repeated for the next two (2) inserts.

If the insert value is greater than the target value, the count of the appropriate counter (i.e., double feed, triple feed, quadruple feed, quintuple feed) is incremented, S39, and the yellow light is lit, S40, whereupon the program exits Sub-Routine 1 (S31, FIG. 11) and returns to S17.

Steps S17 to S28 are repeated and, then the third insert value is obtained. This is recognized as a count of "3", S41*a*. The third analog value is compared with the current target, and, if the value is within 10% of the target, S42*a*, the third value is stored, S43, the initial target and second and third values are averaged, S44, the average value (the "new seed") replaces the original target, S45, and the program repeats Sub-Routine 1, examining the next insert.

The thickness value of the next fed insert is compared with the current target, S32, to determine the number of inserts represented by the value, S33. If the value read is a single feed, S34, the single count is incremented, S35, and the program advances to the SEED UPDATE routine of the Sub-Routine 1 (FIG. 14).

If the value compared with the current target is not a single feed, S34*a*, it is examined to determine if it is a miss (i.e., less than ½ target value), S36. If the value is a miss ("no insert") the miss count is incremented, S37, the red light is lit, S38, and the program jumps to the zero update routine of Sub-Routine 1 (see FIG. 15).

Figure 15:
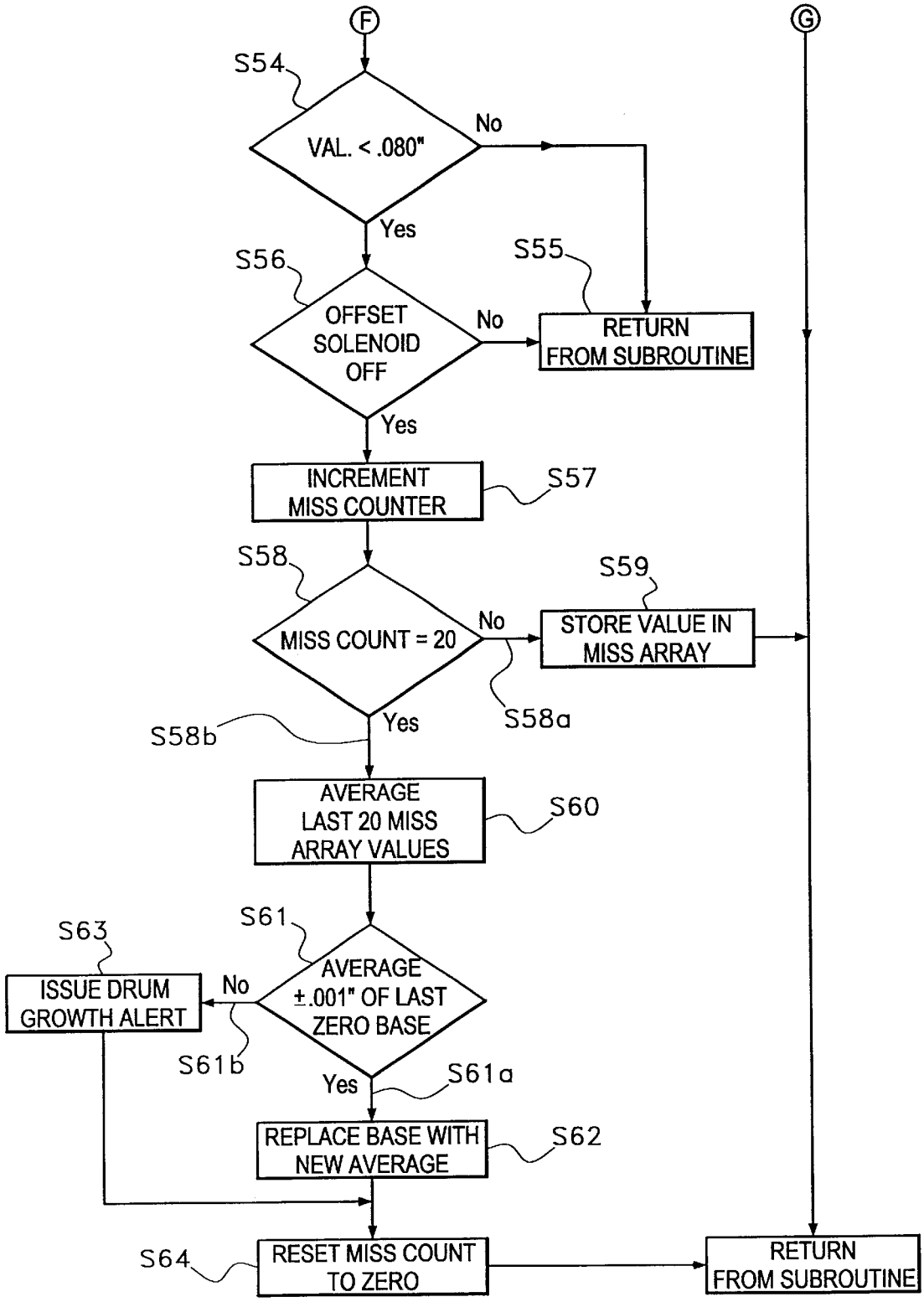

If the insert value is greater than the target value, the count of the appropriate counter (i.e., double feed, triple feed, quadruple feed, quintuple feed) is incremented, S39, and the yellow light is lit, S40, whereupon the program returns from this Sub-Routine (see FIG. 15).

Figure 13:
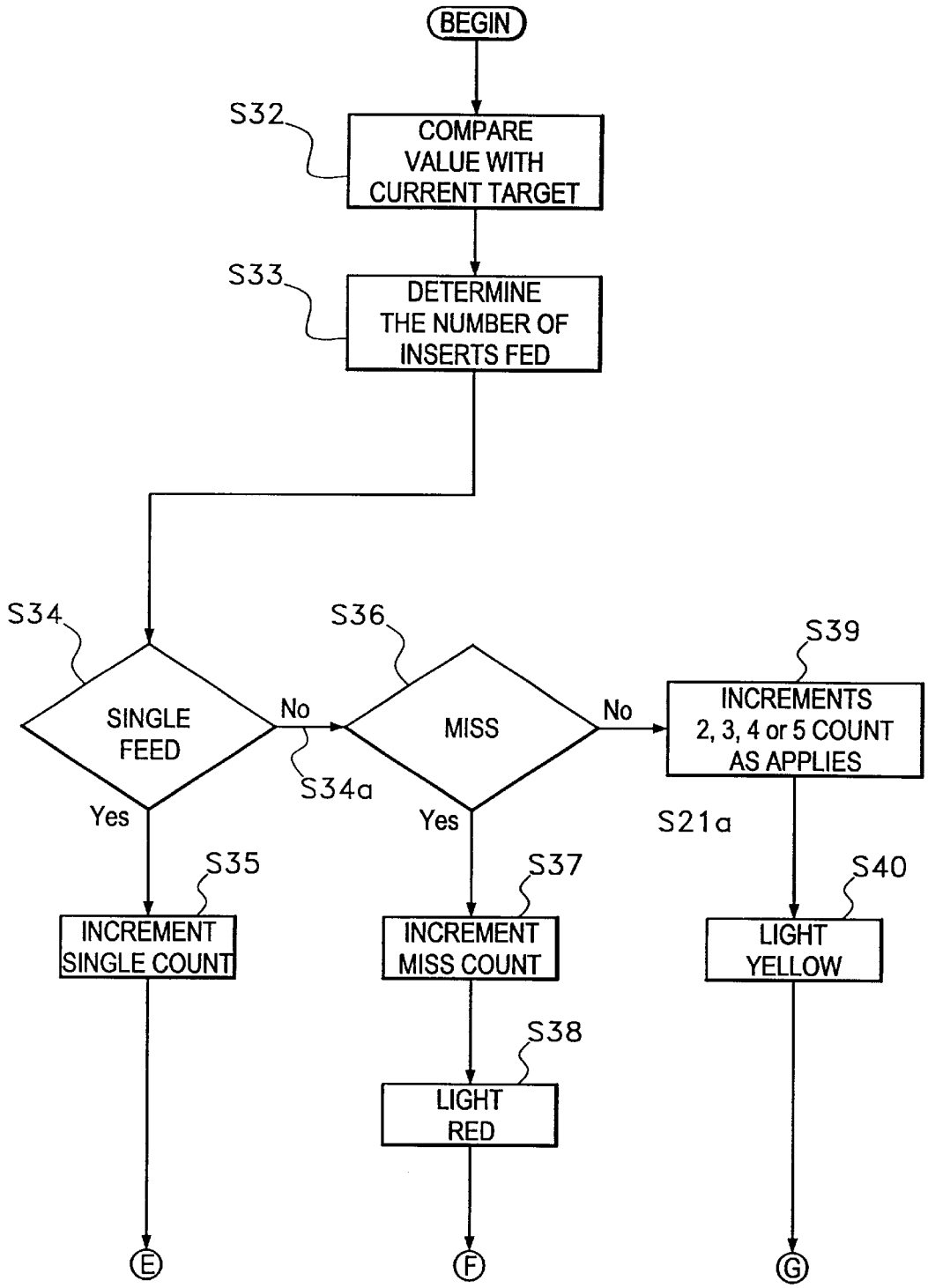
Figure 14:
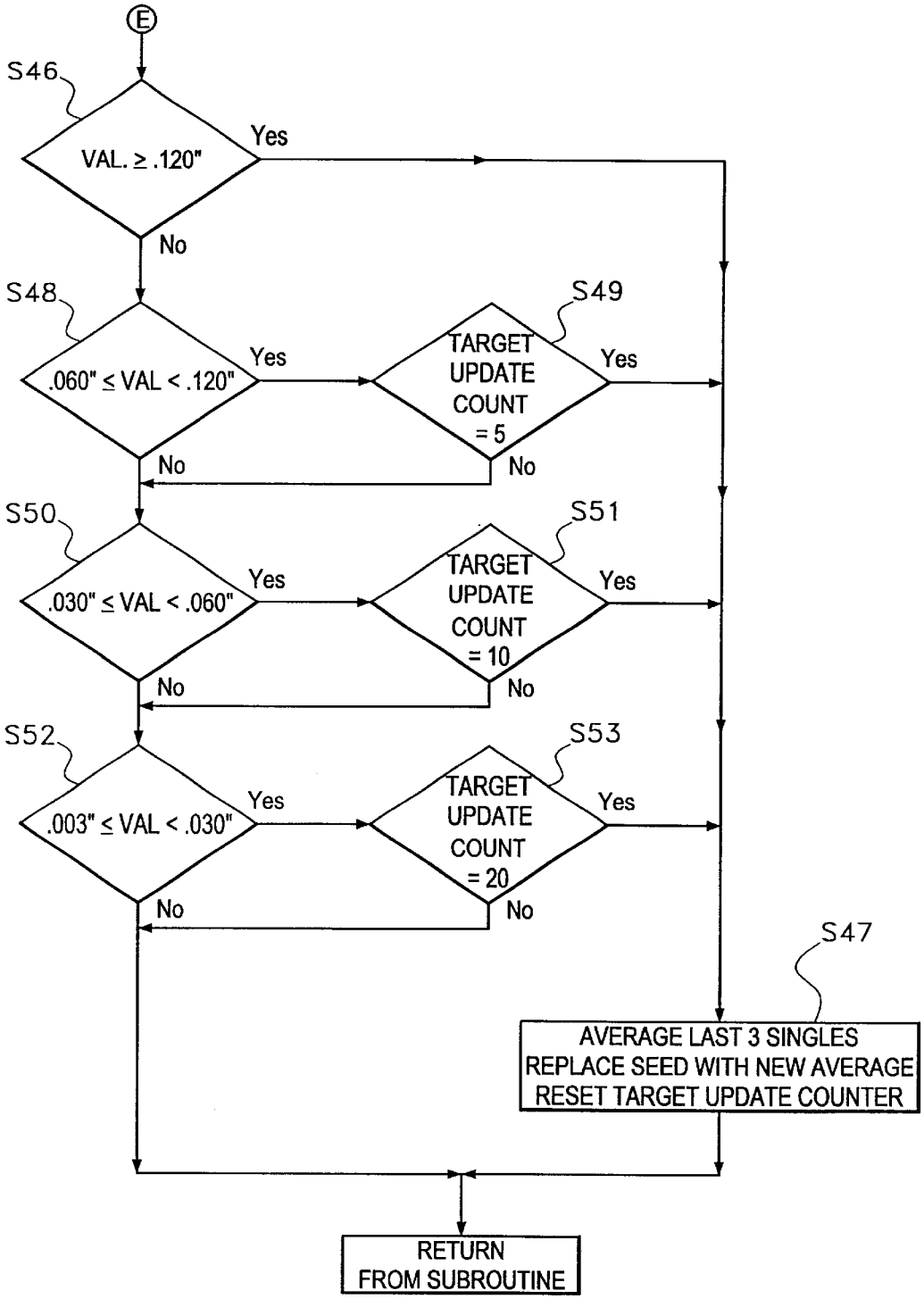

Returning to S35 (FIG. 13), when the insert value represents a single count, the program advances to the SEED UPDATE routine of Sub-Routine 1 (see FIG. 14).

If the analog value Val≧0.120 inches, S46, the next three single values are obtained and averaged and the target update counter is reset to zero, S47. Analog values Val≧0.120 are thus updated every insert and the program then exits Sub-Routine 1.

If Val<0.120, and if 0.060<Val, S48, the target update counter is examined, S49. If the target update counter is a count of "5", S49, step S47 is performed and the program exits Sub-Routine 1. Thus the "seed" is updated every "5" inserts in the preferred embodiment.

In a similar fashion, when the inserts have a thickness value 0.030<Val<0.060, the "seed" is updated every "10" inserts (S50–S51) and when 0.003≦Val<0.030, the "seed" is updated every 20 inserts.

When a "miss" is detected (FIG. 13) a Zero Update Routine is entered (FIG. 15). When the thickness value Val>0.080, the program exits Sub-Routine 1, S54, S55.

If Val is less than 0.08, and the offset solenoid is on, S56, the program exits Sub-Routine 1, S56, S55.

If Val is less than 0.080 (S54) and the offset solenoid is off (S56), the "miss" counter is incremented, S57. If the "miss" counter is <20, S58*a*, the value is stored in the "miss" array.

If the miss count=20, S58*b*, the last 20 miss values are averaged, S60. If the average obtained at S60 is within ±0.001" of the last zero base, S61*a*, the new average replaces the last base, S62. If the average is outside of ±0.001", S61*b*, a "Drum Growth" alert, S63, is given. After the new average replaces the previous base, S62, the "miss" count is reset to zero, S64, and the program then returns from Sub-Routine 1.

Returning to FIG. 12 during the Learn Insert Mode, when the total count of inserts "learned" is less than 3, S41, Sub-Routine 1 is entered, S66, to determine the nature of the next insert, i.e., "single", "miss", "double", "triple", etc. (FIG. 13) and, depending on the nature of each insert, to branch to the SEED UPDATE mode (FIG. 14) when the insert is a "single", the Zero Update Mode (FIG. 15) when a "miss"; and then returns to S15.

When the total count reaches "3", S41 as was described previously, steps S42 through S45 are performed to provide an updated seed, whereupon Sub-Routine 1 is entered, S67.

When either S66 or S67 is completed, the selector switch S is examined, S15. If there is no transition, S15*a*, the program branches ("B" FIG. 12 to "B" FIG. 11) to S16 to repeat the Learn Insert Mode.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein described.

What is claimed is:

1. Apparatus for measuring thickness of inserts as they move along a curved path comprising:

a rotating cam having a curved cam surface extending from a low point to a high point about its circumference, said high point serving as a reading position;

a sensor fixedly mounted at a given position;

a pivot arm swingable about a fixedly mounted shaft;

a portion of said pivot arm being positioned opposite said sensor and to one side of said shaft;

a bearing mounted on said pivot arm on a side of said pivot arm opposite said shaft;

said pivot arm normally biased by a spring toward a first position urging said bearing toward said cam for measuring a thickness of inserts passing between and engaging said bearing and said cam over a first thickness range, said sensor generating a signal representative of an angular position of said pivot arm, said sensor signal being read when said reading position is aligned with said bearing.

2. The apparatus of claim 1 further comprising means for moving said pivot arm in a direction opposite a bias force of said spring to a second position, spacing said bearing a greater distance from said cam than said first position for measuring a thickness of inserts over a second thickness range greater than said first thickness range.

3. The apparatus of claim 1 further comprising a rotatable caliper arm adjustably secured to a fixed support shaft enabling the caliper arm to be adjusted to a desired position relative to said cam and be maintained stationary at said desired position during a measuring operation;

said pivot arm shaft being joined to said caliper arm;

said sensor being mounted upon said caliper arm.

4. The apparatus of claim 3 wherein a rotating drum assembly moves inserts along said curved path;

a support structure supporting said drum assembly; and caliper arm support arms mounted upon said support structure for supporting said caliper arm.

5. The apparatus of claim 4 further comprising a rod supported by said caliper arm support arms.

6. The apparatus of claim 5 wherein said caliper arm comprises first and second members embracing said rod and being clamped together to releasably secure the caliper arm to said rod.

7. The apparatus of claim 1 further comprising a drum assembly for moving said inserts along said curved path;

a drive shaft for rotating said drum;

a drive sprocket mounted to rotate with said drum drive shaft;

a cam sprocket joined to said cam;

a chain drive for coupling drive from said drive sprocket to said cam sprocket to rotate said cam.

8. The apparatus of claim 7 wherein said drive sprocket comprises sprocket halves embracing said drum shaft and being clamped together to releasably secure the drive sprocket to said drum shaft, said drive sprocket facilitating assembly thereof upon said drum shaft.

9. The apparatus of claim 7 further comprising means for examining an output of said sensor when the high point of said cam is aligned with said caliper bearing.

10. A method for monitoring inserts as they are moved along a path comprising the steps of:

(a) measuring thickness of an insert only as it passes a given measuring location to generate a signal representing said thickness;

(b) determining upper and lower threshold levels from said thickness signal to define a thickness range wherein signals representing inserts within said range are considered a single insert;

signals below the lower threshold level are considered a missed insert;

and signals above said upper threshold level are considered multiple inserts;

(c) generating a signal having a level representing a thickness measurement during a next measuring time when a next insert passes the measuring location; and (d) comparing the signal level obtained during step (c) with the upper and lower threshold levels obtained in step (b)

(e) incrementing a count of one of a plurality of separate storage locations for separately storing a count ofmissed inserts, single inserts and multiple inserts, an appropriate storage location being incremented according to a result obtained in step (d).

11. The method of claim 10 wherein the lower threshold level $T_L$ represents one-half a thickness of an insert, and a signal obtained in step (c) having a level which represents a thickness less than one-half the thickness of an insert is considered to be a missed insert.

12. The method of claim 10 wherein the upper threshold level $T_u$ represents one-and-one-half-times a thickness of an insert, and a signal obtained in step (c) having a level representing a thickness greater than one-and-one-half-times the thickness of an insert is identified as multiple fed inserts.

13. The method of claim 10 wherein the lower threshold level $T_L$, represents one-half a thickness of an insert and the upper threshold level $T_u$ represents one-and-one-half times the thickness of an insert, and a signal obtained in step (c) having a level S, where $0.5<S<1.5$, is considered to be a single insert.

14. The method of claim 12 wherein a signal level which is greater than $T_u$ is divided by the thickness of an insert to determine a number of multiple inserts monitored at step (c); and incrementing one of a group of storage locations each identifying double, triple, quadruple and quintuple thickness determined by the result of the division operation.

15. The method of claim 10 further comprising:

(e) generating a signal level representing thickness of an insert during at least two (2) successive measurement times, summing the signal levels and dividing by the number of signals summed to obtain an average value for a single insert;

(f) obtaining an upper threshold value based on the average value;

(g) obtaining a lower threshold value based on the average value; and (h) comparing each successive signal level obtained during a measurement time with the upper and lower threshold values.

16. The method of claim 15 further comprising counting the measurement times; and repeating steps (e) and (f) after a predetermined count of measurement times.

17. The method of claim 16 wherein the predetermined count of measurement times is selected according to an insert thickness range whereby the predetermined count for periodically generating an average thickness value for an insert is decreased when inserts being handled lie in a greater thickness range and is increased when an insert being handled lies within a smaller thickness range.

18. The method of claim 17 wherein the predetermined count is fifty (50) for an insert thickness range of from 0.003 to 0.03 inches.

19. The method of claim 17 wherein the predetermined count is twenty (20) for an insert thickness range of from 0.003 to 0.03 inches.

20. The method of claim 17 wherein the predetermined count is ten (10) for an insert thickness range of from 0.030 to 0.060 inches.

21. The method of claim 17 wherein the predetermined count is five (5) for an insert thickness range of from 0.060 to 0.120 inches.

22. The method of claim 17 wherein the predetermined count is one (1) for an insert thickness range greater than 0.120 inches.

23. A method of determining a linear range of a proximity sensor measuring thickness of inserts moving along a given path by determining a displacement distance of said sensor from an arm movable by an insert between a first position representing a small thickness to a second position representing a large thickness, said sensor sensing a position of said arm for generating an analog voltage as said arm moves, comprising the steps of:

a) halting movement of inserts along said given path;

b) moving said arm along a path between said first and second position;

c) detecting an output voltage generated by said sensor at given intervals as said arm is moved;

d) storing a value at each interval;

e) comparing voltages obtained at each interval with a voltage obtained at a succeeding interval;

f) replacing the stored voltage with a succeeding voltage when a succeeding voltage is less than a preceding detected voltage and;

g) determining a low end of said operating range when said succeeding voltage is not less than a preceding detected voltage.

24. The method of claim 23 further comprising:

moving said sensor from said low end toward said first position;

repeating steps (a) and (b), comparing each successive voltage value with preceding voltage value and storing a succeeding voltage value when a succeeding voltage value is k times greater than a preceding voltage value, where k is a constant; and determining an upper limit of said linear range when a succeeding voltage value is less than k times a stored voltage value.

25. A method for measuring insert thickness over a selected one of two ranges, a first lower range having an upper end value substantially equal to a lower end value of a second upper range; comprising the steps of:

a) selecting one of said ranges;

b) generating a signal having a level representing a thickness of an insert being measured; and c) generating an invalid signal when a level obtained during step (b) is above said lower end value when operating in said first range or generating an invalid signal when a level obtained is below said lower end value when operating in said second range.

26. A method for adjusting a caliper assembly preparatory to measuring a thickness of an insert, said assembly including a movable member moved by a passing insert by a distance representing insert thickness and an adjustably mounted proximity sensor for generating a signal representing a position of said movable member, said method comprising the steps of:

a) initiating operation of a device for feeding inserts to said member responsive to detection of a zero-learn mode request;

b) preventing feeding of inserts responsive to a zero-mode request;

c) adjusting a position of said proximity sensor;

d) detecting an output of said proximity sensor at a given instant;

e) comparing the value obtained in step d) with upper and lower limits of an operating range;

f) storing the value obtained when it is within the limits of said operating range; and g) generating a visual display indicating storage of a value.

27. The method of claim 26 further comprising repeating steps (a) through (g) in a continuing presence of said zero-learn mode when said value is not in said operating range.

28. The method of claim 26 wherein step (g) further comprises generating a flashing display of a predetermined color.

29. A method for adjusting a caliper assembly preparatory to measuring a thickness of an insert, said assembly including a movable member moved by a passing insert by a distance representing insert thickness and a proximity sensor for generating a signal representing to a position of said movable member, said method comprising the steps of:

a) initiating operation of a device for feeding inserts to said member responsive to detection of a zero-learn mode request;

b) preventing feeding of inserts responsive to a zero-mode request;

c) reading an output of said proximity sensor at a an initial position;

d) comparing a value ofthe output obtained in step c) with upper and lower values respectively representing upper and lower limits of an operating range;

e) storing the value obtained when it is within the limits of said operating range; and f) adjusting a position of the proximity sensor relative to said moveable member when the value obtained in step d) is outside of said upper and lower limits.

30. A "learn-insert" method for initializing a caliper assembly to handle given insert method for operating a caliper assay preparatory to measuring a thickness of an insert, said assembly including a movable member moved by a passing insert by distance representing insert thickness and a proximity sensor for generating a signal responsive to a position of said movable member, said method coupling the steps of:

a) initiating operation of a device for feeding inserts to said member responsive to detection of a learn mode request;

b) feeding a single insert into the feeding device;

c) detecting a presence of output of said proximity sensor at a given instant;

d) determining a value of said output;

e) storing the value if the value is within said limits;

f) repeating steps (a) through (d) to obtain a second value;

g) storing a value if it is within a given percent of the first value;

h) repeat steps a) through d) to obtain a second value;

i) storing a value if it is within a given percent of the first value;

j) averaging the first, second and third values to obtain an average value;

k) replacing the first value stored with the average value.

31. The method of claim 30 further comprising:

n) feeding inserts to said device for feeding;

o) reading an output of said sensor for generating a value representing a thickness of each insert;

p) comparing each thickness value with the limits stored at step m);

q) incrementing a single feed insert count when the thickness value of the insert is within the upper and lower limits obtained in step m);

r) incrementing a miss feed count when the insert thickness value is less than the lower limit obtained in step m); and s) incrementing a double feed count when the insert thickness value is above the upper limit obtained in step m).

32. The method of claim 31, further comprising: determining triple, quadruple and quintuple thickness ranges based on the average value obtained in step m); and; incrementing one of a triple, quadruple and quintuple count when the insert thickness value lies respectively within a triple, quadruple or quintuple range.

33. The method of claim 26 further comprising:

i) displaying a steady light of a first color when the output value compared at step (f) is below a value representing said lower limit;

j) displaying a steady light of a second color different from said first color when the output value obtained at step (f) is above a value representing said upper limit; and k) simultaneously displaying flashing light of said first and second colors when the output value compared at step (f) is between the values representing said lower and upper limits.

34. A method for developing an average value used as a criteria for measuring inserts, comprising;

a) feeding inserts past a measuring location;

b) detecting a thickness of a first insert and generating a value representing thickness of the first insert;

c) comparing the thickness value of the first insert with initial preset upper and lower limits;

d) storing the thickness value if the first insert thickness value lies within said upper and lower limits;

e) detecting a thickness of a second fed insert and generating a value representing thickness of the second insert;

f) comparing the thickness value of the second insert with said upper and lower limits;

g) storing the second insert thickness value only if the second insert thickness value lies within said preset upper and lower limits and is a value which is not greater than 110% and not less than 90% of the value stored at step (d);

f) detecting a thickness of a third insert and generating a value representing thickness of the third insert;

g) comparing a thickness value ofthe third insert with the initial preset upper and lower limits;

h) storing the third thickness value if the third thickness value lies within said upper and lower limits and is greater than 90% of the value stored at step (d) and not greater than 110% of the value stored at step (d);

i) averaging the stored thickness value of the first, second and third inserts;

j) calculating upper and lower limits based on the average value determined at step (i); and k) replacing the initial preset upper and lower limits with the upper and lower limits determined at step (j).

35. A method for measuring thickness of inserts moving past a proximity sensor provided at a reading location, comprising:

a) reading, at given intervals, an output signal of said sensor, said signal having a value representing a thickness of an insert passing the reading location;

b) comparing the value of each signal read at said reading location with initial preset upper and lower limits to determine if the signal represents a miss feed, a double feed or single feed;

c) accumulating a count of miss-feeds, double feeds and single feeds in separate storage locations;

d) storing thickness values of each miss feed;

e) averaging the stored miss feed values when the count of miss feeds reaches a given number; and f) replacing the initial preset lower limit with the average value obtained at step (e) when a difference between the average value and said original initial lower limit value is within a given amount.

36. A method for monitoring a rotating feed drum employed to feed inserts past a proximity sensor for generating a signal representing a thickness of an insert passing the sensor, comprising:

a) reading an output of said sensor upon the occurrence of each half revolution of said drum in the absence of inserts;

b) comparing two successive outputs read from said sensor;

c) generating a warning signal when a difference of the values compared at step (b) is greater than a given amount.

37. The apparatus of claim 1 further comprising a carry-down roller arm having a roller positioned upstream relative to said bearing for preventing an insert from moving away from said bearing as the insert moves toward the bearing, said roller being positioned to engage a surface of an insert engaged by said bearing.

38. The apparatus of claim 1 wherein said cam is driven by a drive apparatus coupled to a roller assembly for feeding inserts between said cam and said bearing to cause said high point to be aligned with said bearing when a leading edge of an insert has moved a given distance away from the alignment of said bearing with said high point.

* * * * *

UNITED STATES PATENT AND TRADEMARK OFFICE

CERTIFICATE OF CORRECTION

PATENT NO. : 6,405,152 B1
DATED : June 11, 2002
INVENTOR(S) : Hall et al.

Figure 2:
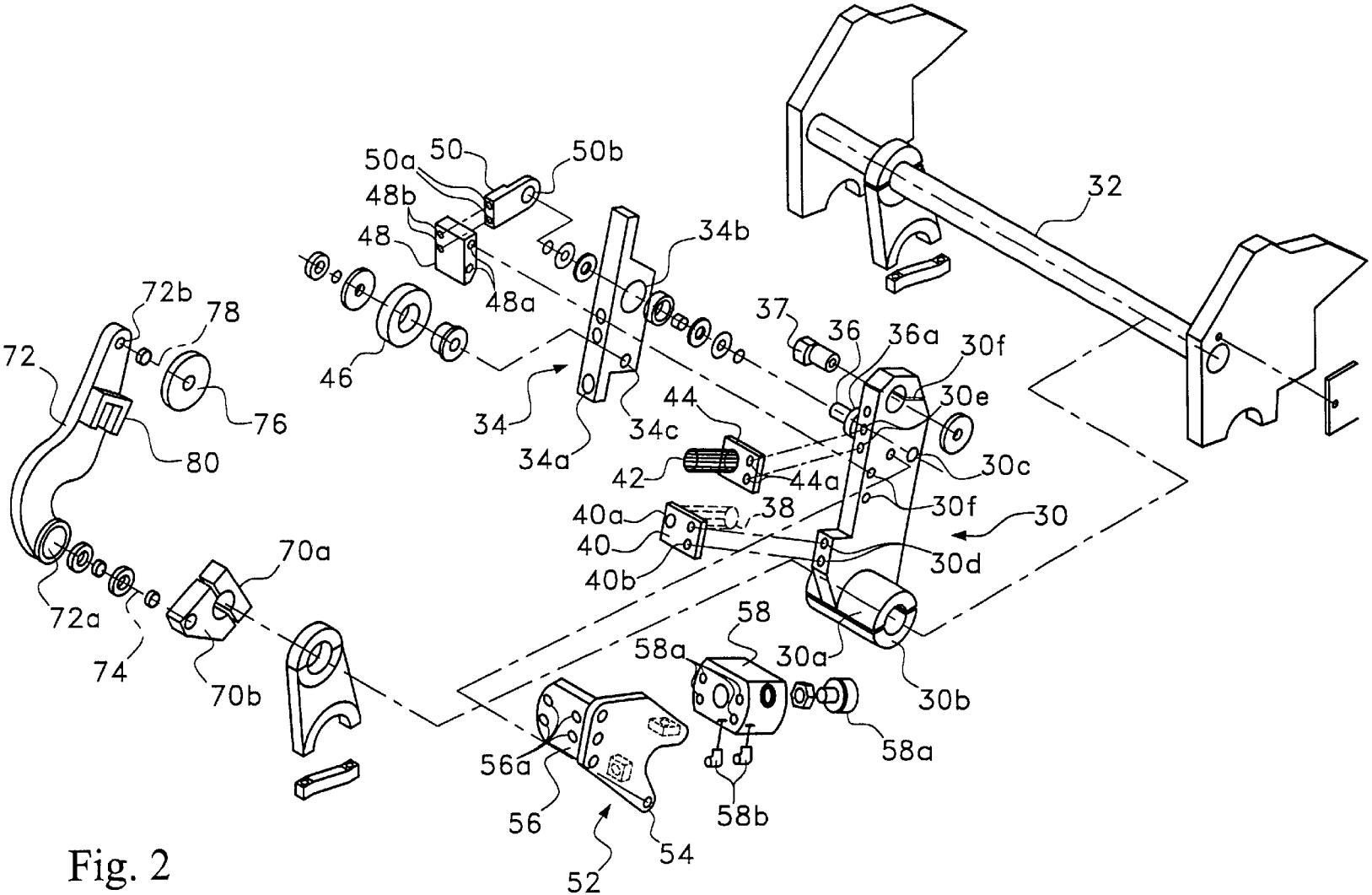
FIGS. 2 and 3 are exploded perspective views showing the caliper system of FIG. 1 and showing most of the components in FIG. 1, respectively.
Figure 3:
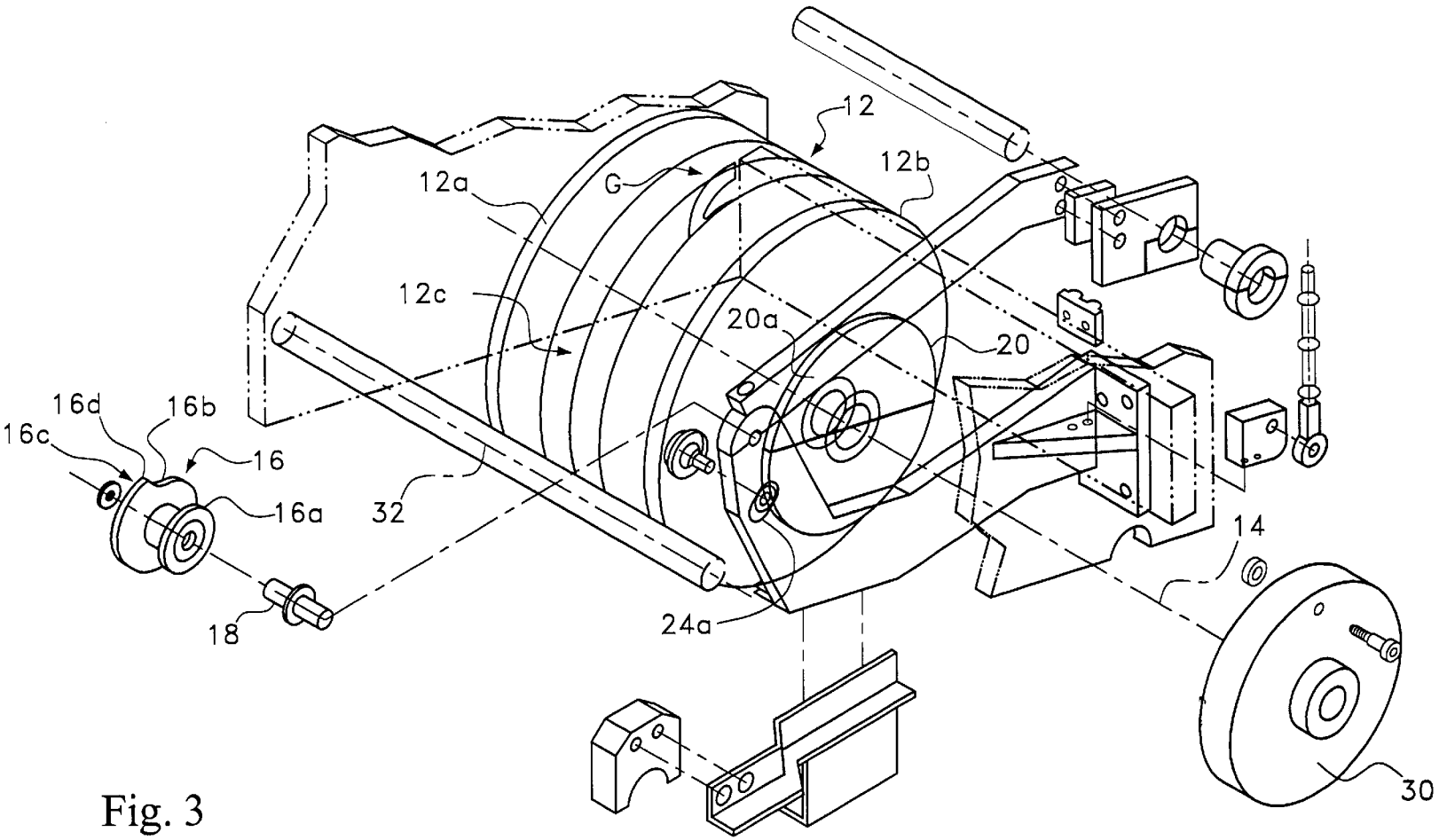

It is certified that error appears in the above-identified patent and that said Letters Patent is hereby corrected as shown below:

Drawings,
Sheet 2, figure 2, the integral shaft forming part of stop member 37, should be labeled -- 37a --to conform with the phrase "integral shaft 37a" at column 5, line 13.
Sheet 3, figure 3, delete element number "30" and insert therefor -- 31 --.

Column 3,
Line 58, after the word "10", delete "ofthe" and insert therefor -- of the --.

Column 4,
Line 57, after the word "type,", delete "control" and insert therefor -- controls --.
Line 59, after the word "into", delete "the" and insert therefor -- gripper --.
Line 60, after the word "signature", delete "of" and insert therefor -- or --.
Line 61, after the word "eight", delete "o'clok position," and insert therefor -- o'clock position --.
Line 61, after the word "is", delete "convention" and insert therefor -- conventional --.

Column 8,
Line 33, after the word "an", delete "operatorjogs" and insert therefor -- operator jogs --.
Line 58, please insert -- 5. -- before the word "Drum".
Line 61, after the word "be", delete "withing" and insert therefor -- within --.

Column 11,
Line 33, please insert -- 2. -- before the word "The"
Line 38, after the word "direction", delete "ofrotation and insert therefor -- of rotation --.

Column 12,
Line 12, after the word "placement", delete "ofthe" and insert therefor -- of the --.

Column 15,
Line 32, after the word "value", delete "0.030<Val<0.060" and insert therefor -- 0.030•Val<0.060 --.

UNITED STATES PATENT AND TRADEMARK OFFICE

CERTIFICATE OF CORRECTION

PATENT NO. : 6,405,152 B1
DATED : June 11, 2002
INVENTOR(S) : Hall et al.

It is certified that error appears in the above-identified patent and that said Letters Patent is hereby corrected as shown below:

Column 19,
Line 39, after the word "at", delete "a".
Line 41, after the word "value", delete "ofthe" and insert therefor -- of the --.

Column 20,
Line 8, after the word "value", insert therefor
-- ; I) replacing the first value stored with the average value; and
m) determining and storing upper and lower limits of thickness range based on said stored average value. --
Line 66, after the word "value", delete "ofthe" and insert therefor -- of the --.

Signed and Sealed this

First Day of April, 2003

JAMES E. ROGAN
*Director of the United States Patent and Trademark Office*